United States Patent [19]

Hanakata et al.

[11] 4,096,935

[45] Jun. 27, 1978

[54] INPUT DEVICE

[75] Inventors: Takayoshi Hanakata, Yokohama; Shunji Mitaka, Kawasaki, both of Japan

[73] Assignee: Canon Kabushiki Kaisha, Tokyo, Japan

[21] Appl. No.: 713,884

[22] Filed: Aug. 12, 1976

Related U.S. Application Data

[63] Continuation of Ser. No. 551,394, Feb. 20, 1975, abandoned.

[30] Foreign Application Priority Data

| | | |
|---|---|---|
| Feb. 22, 1974 | Japan | 49-21682 |
| Feb. 22, 1974 | Japan | 49-21683 |
| Feb. 7, 1975 | Japan | 50-16101 |

[51] Int. Cl.[2] ..... B41J 5/12

[52] U.S. Cl. ..... 400/479; 200/159 B; 340/365 R; 400/495.1; 400/120; 400/88

[58] Field of Search ..... 197/17, 19, 91, 98, 197/133 R, 181; 178/17 C, 81; 200/5 C, 50 C, 159 B; 235/145 R, 146; 340/365 R, 365 C, 365 A

[56] References Cited

U.S. PATENT DOCUMENTS

| | | | |
|---|---|---|---|
| 2,343,060 | 2/1944 | Horning | 200/159 B X |
| 2,813,160 | 11/1957 | Tong | 200/5 C X |
| 3,482,671 | 12/1969 | Shattuck | 197/91 |
| 3,696,908 | 10/1972 | Gluck et al. | 197/98 |
| 3,778,818 | 12/1973 | Scholten | 197/98 X |
| 3,783,205 | 1/1974 | Boulanger | 200/159 B X |
| 3,823,808 | 7/1974 | Murata et al. | 197/133 R |
| 3,844,395 | 10/1974 | Mero et al. | 197/1 R |
| 3,845,850 | 11/1974 | Herr et al. | 197/1 R |
| 3,862,679 | 1/1975 | Ozimek et al. | 197/181 |
| 3,924,722 | 12/1975 | Wienhold | 197/19 |
| 3,987,437 | 10/1976 | Hatsukano et al. | 340/365 S |

*Primary Examiner*—Paul T. Sewell

*Attorney, Agent, or Firm*—Fitzpatrick, Cella, Harper & Scinto

[57] ABSTRACT

An input device is provided with simplified operation for correcting errors. One key is adapted to perform a plurality of key functions, for instance, one function feeds a recording medium backwardly, another prints an error mark. Such key is provided with a bridge member which is interposed, in bridge configuration, between the bottom part of the key top and switch contact member located over other switch contact elements in a pair with said switch contact members. When one key is depressed, a plurality of key switches are actuated.

11 Claims, 20 Drawing Figures

SET 1
104
DECODER
106
108
110
112
114
E1
E2
E3
E4
100.1
100.2
100.3
E2
D2
G
KST
98
82
80
74
68
78
72
66
76
70
64
84
60
58
56
54
62
86
SHIFT REGISTER
102
102.1
CP
G
J
IH

CP
50
F1
F2
F3
F4
F5
52
DECODER
D1
D2
D3
D4
D5
D6
D7
D8
K11
K12
K13
K14
K21
K31
K41
K51
K61
K71
K81
K24
K34
K44
K54
K64
K74
K84
L1
L2
L3
L4
88
90
92
94
96

FIG. 7

| CP | F1 | F2 | F3 | F4 | F5 | |
|---|---|---|---|---|---|---|
| 1 | 0 | 0 | 0 | 0 | 0 | K11 |
| 2 | 1 | 0 | 0 | 0 | 0 | K12 |
| 3 | 0 | 1 | 0 | 0 | 0 | K13 |
| 4 | 1 | 1 | 0 | 0 | 0 | K14 |
| 5 | 0 | 0 | 1 | 0 | 0 | K21 |
| 6 | 1 | 0 | 1 | 0 | 0 | K22 |
| 7 | 0 | 1 | 1 | 0 | 0 | K23 |
| 8 | 1 | 1 | 1 | 0 | 0 | K24 |
| 9 | 0 | 0 | 0 | 1 | 0 | K31 |
| 10 | 1 | 0 | 0 | 1 | 0 | K32 |
| 11 | 0 | 1 | 0 | 1 | 0 | K33 |
| 12 | 1 | 1 | 0 | 1 | 0 | K34 |
| 13 | 0 | 0 | 1 | 1 | 0 | K41 |
| 14 | 1 | 0 | 1 | 1 | 0 | K42 |
| 15 | 0 | 1 | 1 | 1 | 0 | K43 |
| 16 | 1 | 1 | 1 | 1 | 0 | K44 |
| 17 | 0 | 0 | 0 | 0 | 1 | K51 |
| 18 | 1 | 0 | 0 | 0 | 1 | K52 |
| 19 | 0 | 1 | 0 | 0 | 1 | K53 |
| 20 | 1 | 1 | 0 | 0 | 1 | K54 |
| 21 | 0 | 0 | 1 | 0 | 1 | K61 |
| 22 | 1 | 0 | 1 | 0 | 1 | K62 |
| 23 | 0 | 1 | 1 | 0 | 1 | K63 |
| 24 | 1 | 1 | 1 | 0 | 1 | K64 |
| 25 | 0 | 0 | 0 | 1 | 1 | K71 |
| 26 | 1 | 0 | 0 | 1 | 1 | K72 |
| 27 | 0 | 1 | 0 | 1 | 1 | K73 |
| 28 | 1 | 1 | 0 | 1 | 1 | K74 |
| 29 | 0 | 0 | 1 | 1 | 1 | K81 |
| 30 | 1 | 0 | 1 | 1 | 1 | K82 |
| 31 | 0 | 1 | 1 | 1 | 1 | K83 |
| 32 | 1 | 1 | 1 | 1 | 1 | K84 |

ML1
ML2
ML3
ML4
TMD

MD6
MD5
MD4
MD3
MD2
MD1
RS
128
130
122
124
126
FF
FF
TMD
ML
132
134
136
138
140
ML4
ML3
ML2
ML1
142
144
146
148
150
M
V
GM1
E1
E2
OS
END
GM2
TMD
GM3
GSS

INPUT DEVICE

This is a continuation, of application Ser. No. 551,394 filed Feb. 20, 1975, now abandoned.

BACKGROUND OF THE INVENTION

1. Field of the Invention

The present invention relates generally to an electronic device of the type wherein information to be processed is entered by the depression of keys on a keyboard, and more particularly to an input device for entering information into an electronic device.

2. Description of the Prior Art

In the conventional keyboard input equipment, for example, typewriters or the like, alphabet keys are arranged on a keyboard, and the alphabet letter selected by the key is recorded upon a recording medium by recording means. After recording, the recording medium is displaced out of the printing position in the equipment by feed means. In addition to the alphabet keys, the keyboard is also provided with a forward space key for forward spacing and a back space key for back spacing so that a suitable symbol such as "X" may be printed over a misprinted letter. The forward space key must perform two functions, one of which is to provide a space between the words and letters while the other is to continuously drive the recoring tape or the like without printing. In conventional typewriters, when one depresses the space key with a little pressure as he does the alphabet keys, one letter space is formed, but when he depresses with more pressure, a repeating forward spacing takes place. In other words, single or repeat spacing is selected depending upon the depression stroke of the space key. However, it is very difficult for small-sized input equipment to provide such a repeat space key as used in a large-sized typewriter because of restrictions on space and economy.

When keyboard input equipment is used, erratic operation tends to occur very often. A misprinted letter may be erased by an erasure, and a correct letter may be printed, but when electrolytic, discharge destruction electrostatic, heat-sensitive recording paper or the like are used in order to attain a high printing speed and to reduce noise, the letters once recorded thereupon cannot be erased. Therefore, the misprinted letter must be brought back to the printing position and an error mark such as "X" must be printed over the misprinted letter. For this purpose, the operator must accomplish rather complex and tedious operations. He must first find the back space key, and then depress the error mark key to print the error mark upon the misprinted letter.

SUMMARY OF THE INVENTION

In view of the above, one of the objects of the present invention is to provide an input device which overcomes the above problems.

Another object of the present invention is to provide an input device adapted for use with small-sized electronic devices.

A further object of the present invention is to provide an input device in which a plurality of instructions or information may be selectively entered by a single key.

A further object of the present invention is to provide an input device adapted for use with printing equipment.

The above and other objects, features and advantages of the present invention will become more apparent from the following description of the preferred embodiments thereof taken in conjunction with the accompanying drawings.

BRIEF DESCRIPTION OF THE DRAWINGS

FIG. 7 is a diagram used for the explanation of the mode of operation of the encoder shown in FIG. 6;

DESCRIPTION OF THE PREFERRED EMBODIMENT

First Embodiment

Figure 1:
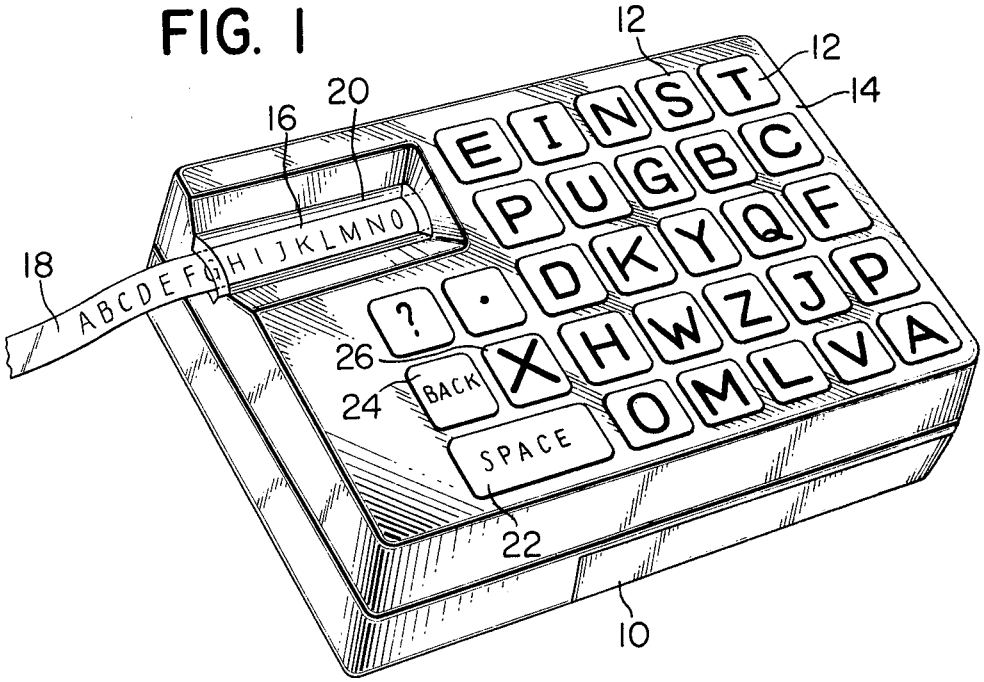
FIG. 1 is a perspective view of a handy typewriter incorporating an input device in accordance with the present invention.

FIG. 1 is a perspective view of a handy typewriter incorporating an input device in accordance with the present invention. The main body 10 of the typewriter has a keyboard 14 with alphabet keys 12 thereupon. When one depresses the key 12, the corresponding letter 16 is printed upon a heat sensitive recording paper tape 18 by, for instance, thermal recording means to be described hereinafter, and the paper tape 18 is discharged through a passage upon which is placed a magnifying plate 20 made of, for instance, acrylic resin so that the magnified printed letter may be seen. The keyboard 14 further includes a forward space key 22, a back space key 24 and a correction key 26 which has a dual function for printing the letter "X" and printing the correction mark "X" upon the mistyped letter.

Figure 2:
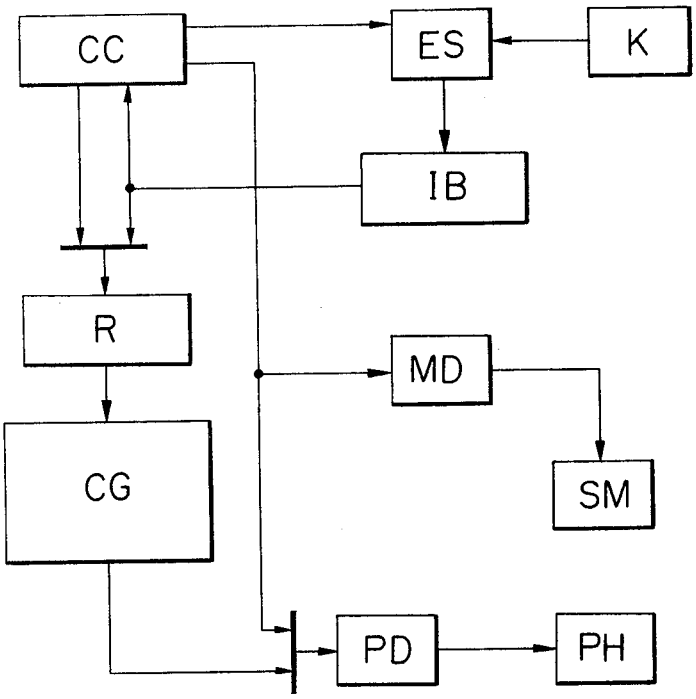
FIG. 2 is a block diagram the handy typewriter shown in FIG. 1.

FIG. 2 is a block diagram of the typewriter shown in FIG. 1. When one of the keys K is depressed, the corresponing letter is encoded into a coded signal by an encoder ES, and is transferred into an input buffer IB. A control circuit CC detects the content in the input buffer IB to generate the corresponding control signal. In response to the control signal from the control circuit CC, the coded signal in the input buffer IB is transferred into a register R and then transmitted to a character generator CG so that the encoded signal is converted into printing signals. In response to the timing signal from the control circuit CC, the printing signal is transmitted to a printer drive PD which drives a thermal printing head PH to print the letter upon the recording paper tape placed in opposed relation with the printing or thermal head PH. In response to the drive control signal from the control circuit CC, a motor drive MD is actuated so that a motor such as a stepping motor SM is driven to transport the recording paper tape 16 (See FIG. 1).

Figure 3:
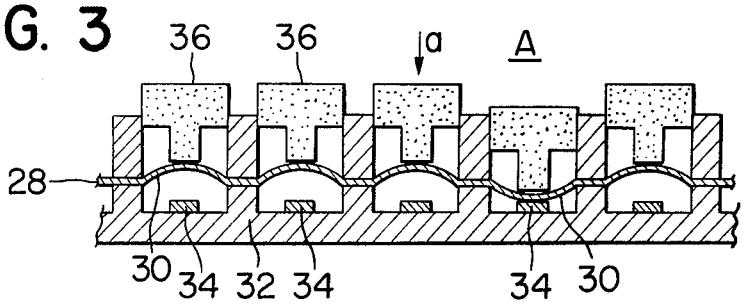
FIG. 3 is a sectional view of an alphabet key shown in FIG. 1.

As shown in FIG. 3, each of the alphabet keys 12 comprises a key top 36, a stationary contact 34 on an insulating base plate 32, and a movable contact 30 which is dome-shaped and is interposed between the key top 36 and the stationary contact 34 in contact with the lower end of the key top.

A plurality of dome-shaped movable contacts 30 are formed in a single electrically conductive and elastic plate 28. When the key top 36 is depressed in the direction indicated by the arrow *a*, it forces the dome-shaped movable contact 30 to contact with the corresponding stationary contact 34 as shown at A in FIG. 3.

Figure 4:
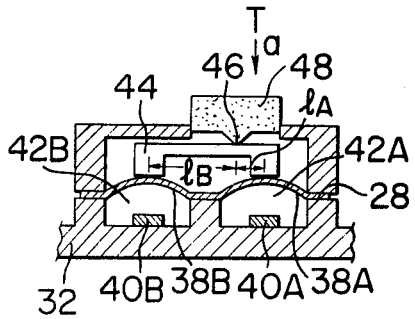
FIG. 4 is a sectional view of a key of a first embodiment of the present invention.

As shown in FIG. 4, the forward space key 22 comprises a key top 48, a bridge-shaped interposer 44, two dome-shaped movable contacts 38A and 38B and two stationary contacts 40A and 40B disposed on the base plate 32 and connected to a printed circuit (not shown) on the plate 32. The dome-shaped movable contacts 38A and 38B are also formed in the conductive plate 28. The stationary contact 40A and the movable contact 38A make up a first switching means 42A while the stationary contact 40B and the movable contact 38B, a second switching means 42B. The interposer 44, which is interposed between the key top 48 and the dome-shaped contacts 38A and 38B, bridges between the contacts 38A and 38B, and is made in contact with a projection 46 extended downwardly from the bottom of the key top 48. The position of the projection 46 is so selected that the forces in suitable ratio may act upon the movable contacts 38A and 38B when the key top 48 is depressed as will be described in more detail hereinafter.

The forward space key 22 with the above construction is connected to the encoder ES.

Next referring to FIG. 5, the encoder ES electrically connected to the keys shown in FIG. 1 will be described. A five-bit counter 50 has five stages or flip-flops F1, F2, F3, F4 and F5 which are weighted 1, 2, 4, 8 and 16, respectively. Therefore, the content in the counter 50 changes as shown in FIG. 7 in response to the clock pulses CP shown in FIG. 6. More particularly, when the counter 50 receives one clock pulse CP, its content is

1 0 0 0 0 but when it receives 10 clock pulses, its content becomes

0 1 0 1 0.

There is established the one-to-one correspondence between the keys and the encoded signals generated by the counter 50 as shown in FIG. 7. In other words, when one key is depressed, the corresponding encoded signal must be developed. The counter 50 is reset when it receives 32 clock pulses, and it is one of the states shown in FIG. 6 even when the clock pulses are continuously applied thereto.

Figure 6:
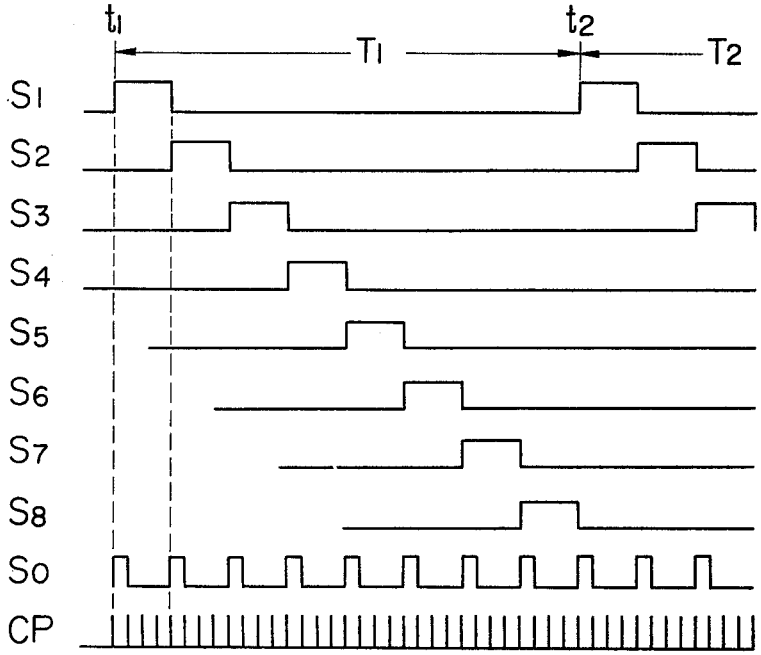
FIG. 6 is a time chart used for the explanation of the encoder shown in FIG. 3.

The 4, 8 and 16 weighted code outputs from the counter 50 are applied to a decoder 52 so that the outputs as shown at S1 through S8 in FIG. 6 are developed from the output lines D1 through D8 of the decoder 52, respectively. In FIG. 6, t1 denote the time point when the counter 50 starts counting; T1, one cycle of 32 clock pulses; and t2, the time point when the counter 50 starts the next counting cycle.

Referring back to FIG. 5, the output lines D1 through D8 are combined with lines L1 through L4 to form a matrix, and short-circuiting key switches K11 through K84 are arranged at the intersection between the output lines D1–D8 and the vertical line L1–L4, so that the outputs from the decoder 52 are transmitted to the lines L1–L4 through the closed key switches K. The lines L1–L4 are connected to NAND gates 54, 56, 58 and 60, respectively to which are simultaneously applied the output from a NOR gate 62 to which, in turn, are applied the 1 and 2 weighted code outputs from the counter 50. The output signal (SO in FIG. 6) from the NOR gate 62 which appears on the output line DO has a pulse duration equal to that of the clock pulse CP, and is derived for every four clock pulses.

A shift register generally indicated by 82 comprises three flip-flops 64, 66 and 68, NAND gates 70, 72 and 74 and NOT gates 76, 78 and 80. To a NAND gate 84 are applied the negation output from the flip-flop 64 and the output from the NAND gate 54. The output from the NAND gate 56 is applied to the NAND gate 70 while the output of the NAND gate 58 is applied to the NAND gate 72. The output from the NAND gate 60 is applied to the NAND gate 74. The clock pulses CP are also applied as shift pulses to the shift register 82 so that the output from the NAND gate 56 may be derived from the NAND gate 84 one clock pulse latter than from NAND gate 54 while the output from the NAND gate 60 is derived from the NAND gate 84 three clock pulses latters than the one from NAND gate 54. The output from the NAND gate 84 is applied to a NAND gate 86. The signal IH which is applied to the NAND gate 86 continues as long the input is applied so that the output may be derived from the NAND gate 86 when and only when both the signal IH and the output from the NAND gate 84 are simultaneously applied to the NAND gate 86.

The input buffer IB comprises five flip-flops 88, 90, 92, 94 and 96 to which are applied the outputs from the stages F1 through F5 of the counter 50 and the output from the NAND gate 86 so that the content in the counter 50 may be stored in the input buffer IB.

The lines L1–L4 are connected to a four-input OR gate 98 for detecting the depression of the key switchs K. The output KST from the OR gate 98 is transmitted through AND gates 100.1 and 100.2 to an AND gate 100.3. To the AND gate 100.1 is applied the inverted output G from the shift register 82 which is delayed by 32 bits by delay means J. To the AND gate 100.2 are applied the output signal from the output line D2 and the signal E2 to be described hereinafter.

A 29-bit shift register 102 and the shift register 82 make up a 32-bit circulating shift register for storing the signal representative of the depressed key.

Figures 5, 8:
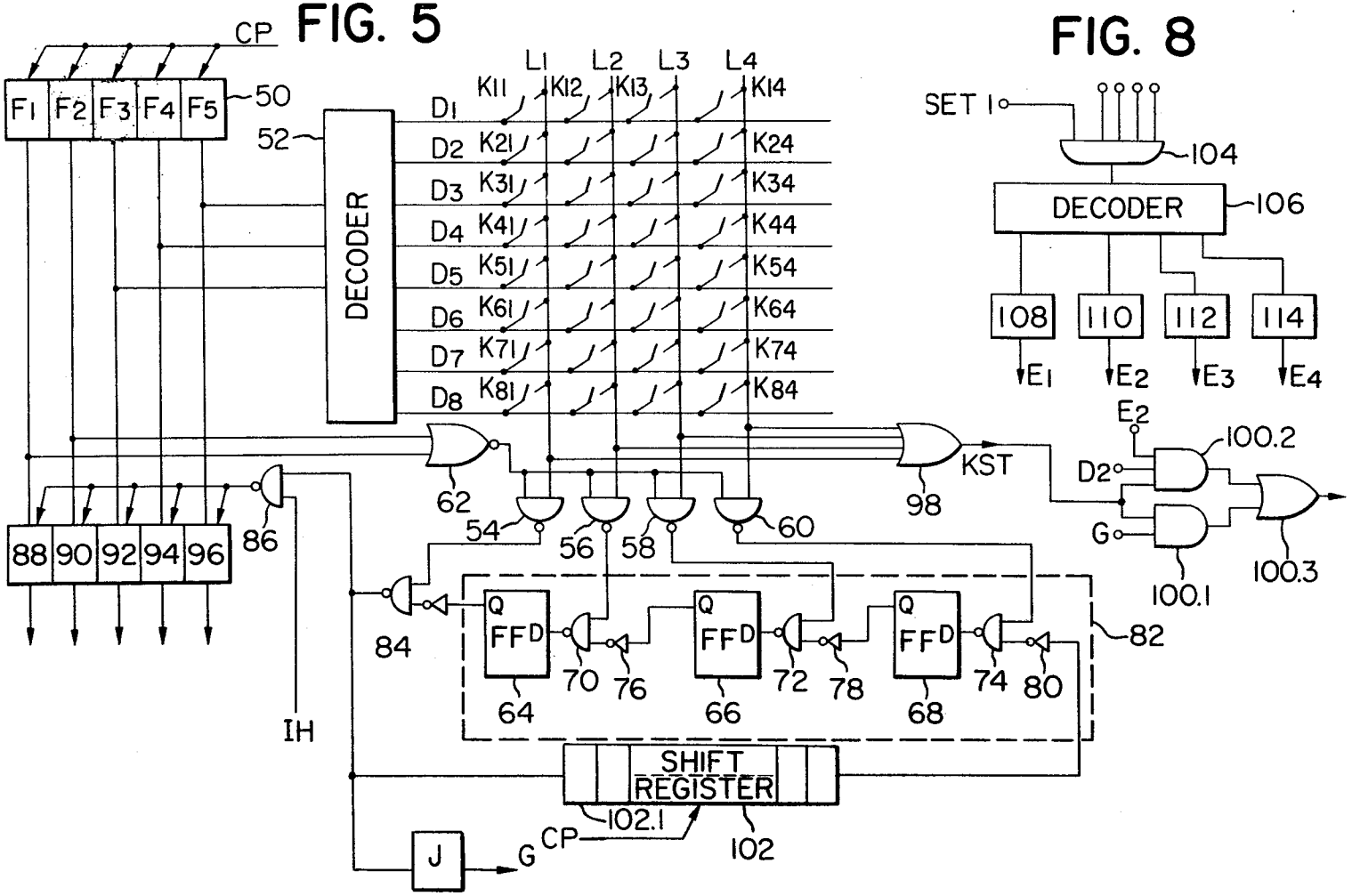
FIG. 5 is a block diagram of an encoder.
FIG. 8 is a block diagram of a control signal generator in a control circuit.

The encoded signal transferred from the encoder ES with the above construction into the input buffer IB is processed in response to the control signal from the control circuit CC shown in FIG. 8. The control circuit CC detects whether the content stored in the buffer IB represents an alphabet letter, forward spacing or other operation so as to generate various control signals. In response to the set signal SET1 generated by pulse counter means (not shown) a predetermined time after the signal KST is derived from the key depression detecting means or OR gate 98 (See FIG. 5), the encoded signal from the input buffer IB is transferred through an AND gate 104 into a decoder 106. The outputs from the decoder 106 are applied to control flip-flops 108, 110, 112 and 114 so that the control signals E1, E2, E3 and E4 corresponding to the encoded signal in the input buffer IB may be derived.

Figure 9:
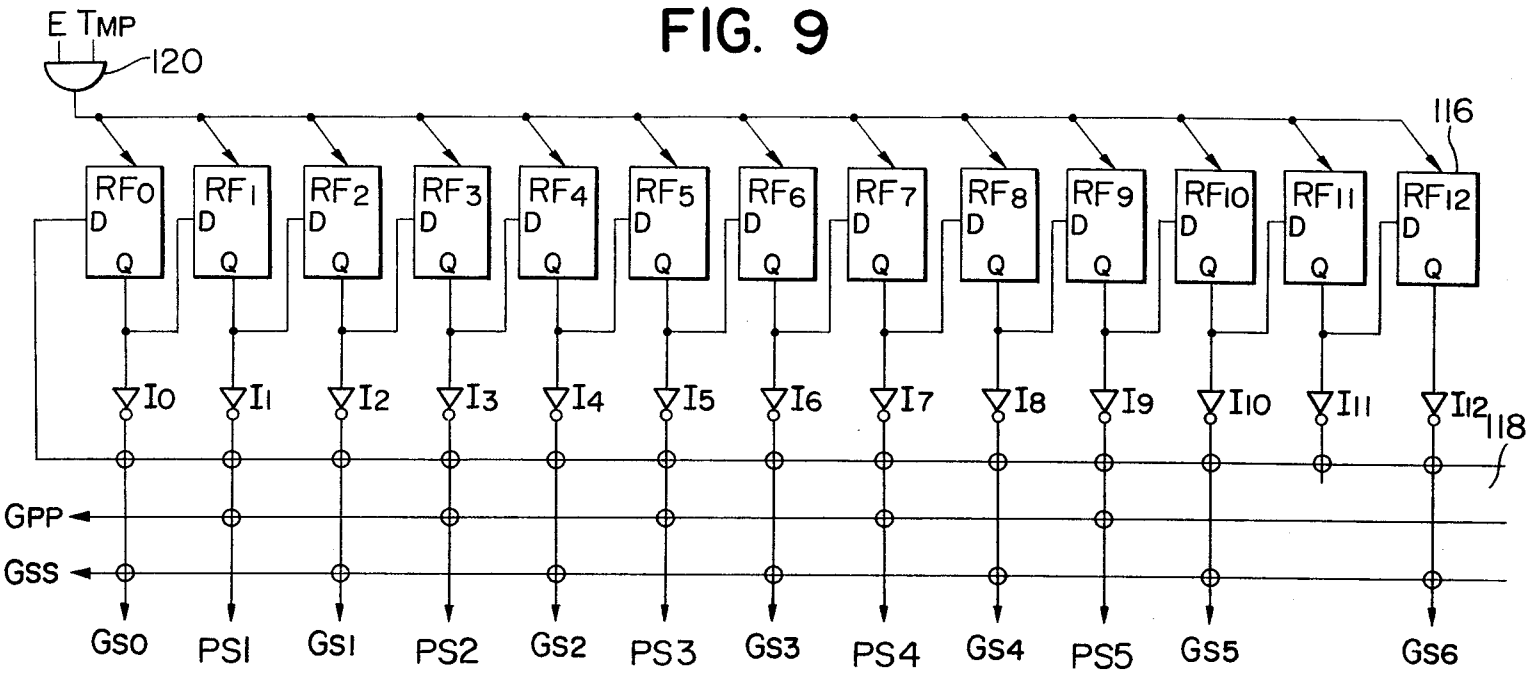
FIG. 9 is a block diagram of a printing control signal generator in the control circuit.

FIG. 9 is a block diagram of the printer control circuit in the control circuit CC for generating the signals for controlling the printing and recording-paper-tape transport operations. Flip-flops RF0-RFI2 make up a ring counter 116, and the outputs from the flip-flop RF0–RFI2 are applied through inverters I0-I12 respectively, to an OR matrix 118. From the vertical lines of the OR matrix 118 are derived the signals GS0, PS1, GS1, PS2, GS2, PS3, GS3, PS4, GS4, PS5, GS5 and GS6 in the order named from left to right. From the horinzontal lines are derived the signals GPP and GSS representing the signals PS1–PS6 and the signals GS0–GS5, respectively. The flip-flops RF0-RF12 in the ring counter 118 are actuated in response to the output from an AND gate 120 to which are applied the clock pulses TMP from clock pulse generator means (not shown) and the print-start signal to be described hereinafter.

Figure 9A:
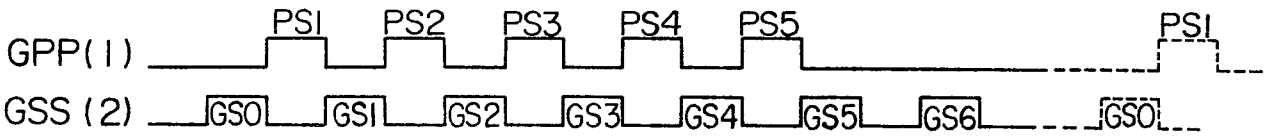
FIG. 9(a) is a diagram used for the explanation of the block diagram shown in FIG. 9.
Figures 10, 10A:
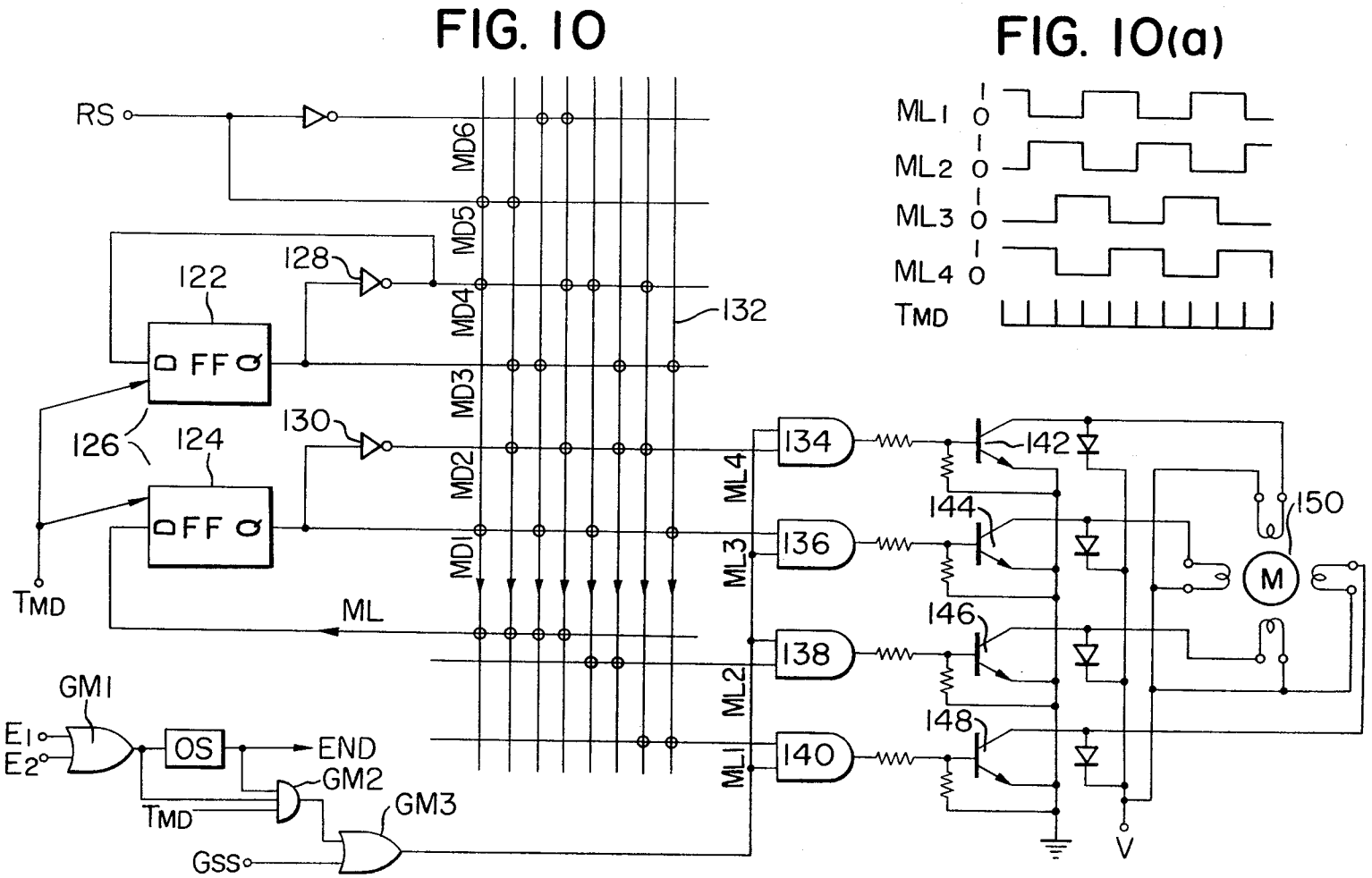
FIG. 10 is a block diagram of a motor drive control signal generating circuit.
FIG. 10(a) is a diagram used for the explanation of the block diagram shown in FIG. 10.

FIG. 10 is a block diagram of the recording paper tape drive control circuit in the control circuit CC. The drive control circuit includes a modulo-4 counter 126 comprising flip-flops 122 and 124. The counter 126 is driven in response to the pulse TMD derived by the countdown of the clock pulses TMP. The pulses TMD have the same pulse width as that of the signal GSS shown in FIG. 9(a), and are always applied to the counter 126. The outputs from the counter 126 are applied through inverters 128 and 130 to the input terminals MD1, MD2, MD3 and MD4 of the matrix circuit 132. To the input terminals MD5 and MD6 of the matrix circuit 132 are applied the control signals from the control circuit CC for driving the step motor in either direction for transporting the recording paper tape as will be described in more detail hereinafter. The output from the matrix circuit 132 is fed back to the modulo-4 counter 126 through the feedback line ML. The output terminals ML1–ML4 of the matrix circuit 132 are connected to AND gates 134, 136, 138 and 140, respectively, to which are also applied the control signal GSS from the control circuit CC. The mode of operation of these AND gates will be described in more detail hereinafter. The outputs at the output terminals ML1–ML4 are shown in FIG. 10(a). The outputs from the AND gates 134, 136, 138 and 140 are applied to the bases of transistors 142, 144, 146 and 148 which make up the motor drive MD. The step motor 150 for driving the recording paper tape is driven in response to the output from the motor drive MD.

Figure 11:
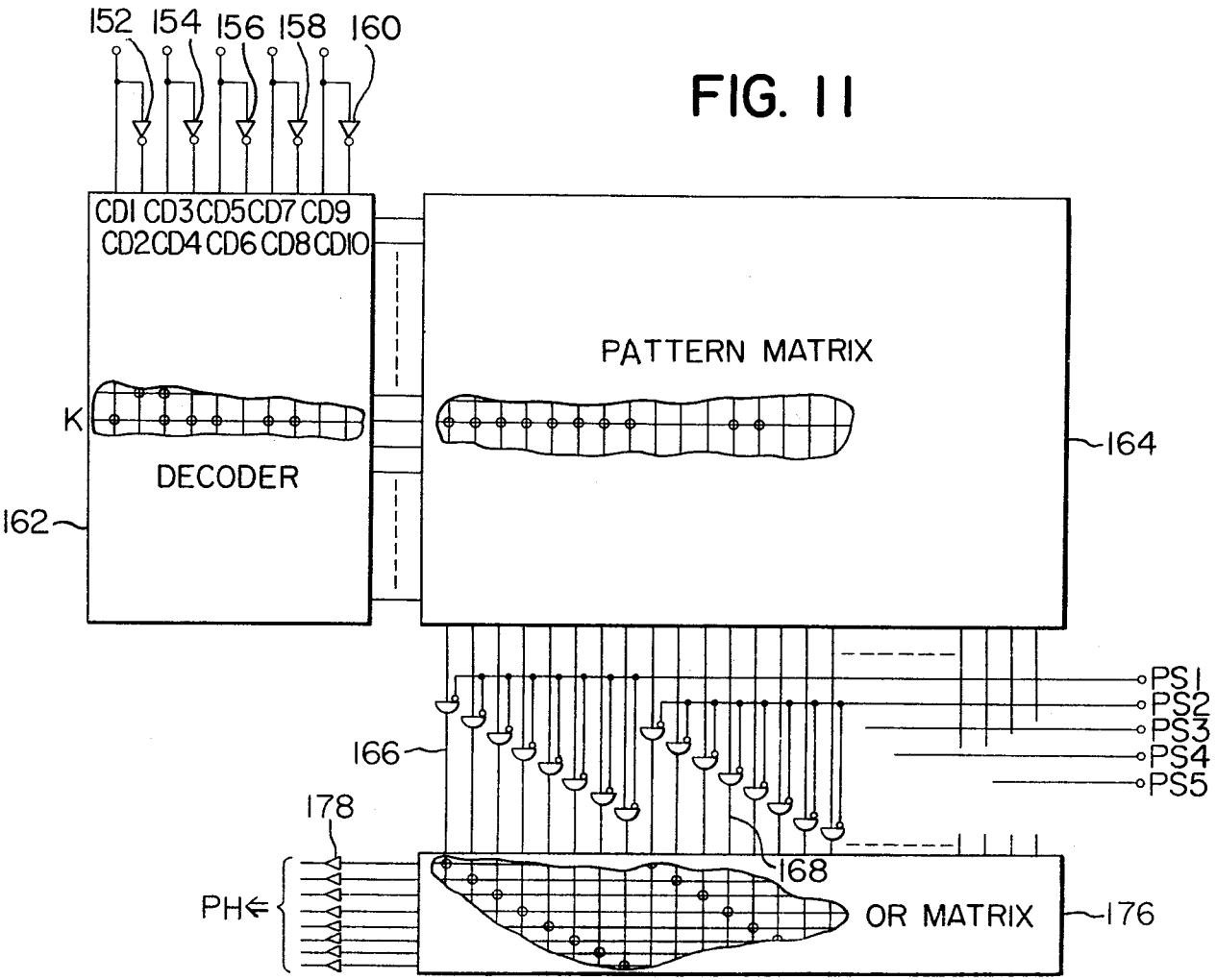
FIG. 11 is a block diagram of a character generator.

FIG. 11 is a block diagram of the character generator CG. In response to the control signal from the control circuit CC, the content in the input buffer IB is transferred into the register R (FIG. 2). The outputs from the register R are applied directly and through inverters 152, 154, 156, 158 and 160, respectively, to the input terminals CD1–CD10 of a decoder 162. The outputs from the decoder 162 are applied to a pattern matrix 164 for generating the signals for printing a letter or symbol. The outputs from the pattern matrix circuit 164 are applied to AND gates 166. 1–7, 168.1–7, 170.1–7, 172.1–7 and 174.1–7 to which are also applied the timing signals PS1-PS5 from the control circuit CC. The outputs from and AND gates 166.1–7 through 174.1–7 are transmitted through an OR matrix circuit 176 to a thermal head drive circuit 178.

Figure 12:
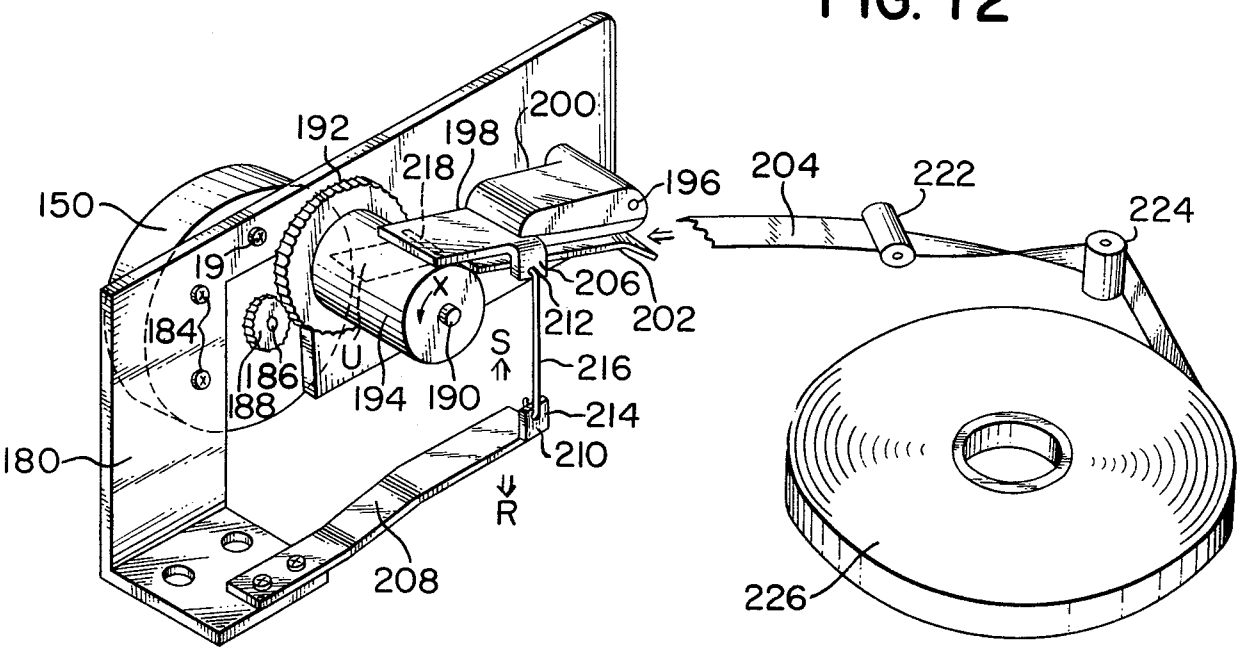
FIG. 12 is a perspective view of a recording tape drive mechanism in the typewriter shown in FIG. 1.

FIG. 12 is a perspective view of a recording paper tape drive mechanism in the handy typewriter shown in FIG. 1. The step motor 150 is mounted with screws 184 upon one side surface of a subframe 180 within the case 10, and a gear 188 is attached to the shaft 186 of the step motor 150. A gear 192 in mesh with the gear 188 and a rubber roller 194 are coaxially and rotatably carried by a shaft 190 attached to the other surface of the subframe 180. The rubber roller 194 serves as a platen. A holding plate 198 upon which is mounted the thermal head PH, is attached to a holder 200 rotatably carried by a shaft 196 attached to the other side surface of the subframe 180. A guide plate 202 is attached with screws to the subframe 182 below the holding plate 198 so that the passage for the paper tape 204 may be formed.

The holding plate 198 is connected through a wire 216 to a leaf spring 208 whose one end is attached to the bottom of the subframe 180. More particularly, one end of the wire 216 is fitted into a small hole 212 formed through the tongue or projection 206 of the holding plate 198 while the other end is fitted into a small hole 214 formed through the upright projection 210 at the other end of the leaf spring 208. Therefore, the leaf spring 208 normally biases the holding plate 198 in the direction indicated by the arrow R so that the holding plate 198 may be normally pressed against the rubber roller 194.

Figure 13:
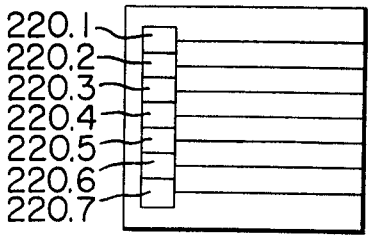
FIG. 13 is a view used for the explanation of a thermal printing head.

Seven heating elements are arranged on the holding plate 198 along the line of contact between the holding plate 198 and the rubber roller 194 into an array in parallel with the axis of the shaft 190 as shown in FIG. 13, so that when they are selectively energized while the recording paper tape 204 is transported, the letters or symbols may be recorded thereupon as will be described in detail hereinafter. The tape 204 is fed through guide rollers 222 and 224 from a roll of paper tape 226 into the printing mechanism. The roll 226 of recording paper tape is housed within the case 10 and is biased by suitable means such as a coiled spring (not shown) in the direction opposite to the direction of feed by the step motor 150.

Next the mode of operation of the first embodiment of the present invention with the above construction will be described hereinafter. The space key 22 (See FIG. 1) with the construction as shown in FIG. 4 has the first and second switching means 42A and 42B, which key 22 correponds to anyone of switches $K_{11}$–$K_{81}$, $K_{12}$–$K_{82}$, $K_{13}$–$K_{83}$ or $K_{14}$–$K_{84}$ on th encoder ES shown in FIG. 5. In the instant embodiment, the common conductor plate 28 of the first and second switching means 42A and 42B; that is the dome-shaped movable contacts 38A and 38B is connected to the line $L_1$ while the stationary contacts 40A and 40B are connected to the output lines D1 and D2 of the decoder 52, respectively. As shown in FIG. 4 the distance *l*A between the projection 46 and the dome-shaped contact 38A is shorter than the distance between the projection 46 and the dome-shaped contact 38B. When one depresses the key top 48 with the force T in the direction indicated by the arrow *a* in FIG. 4, the force (T*l*B)/(*l*A + *l*B) is exerted to the dome-shaped contact 38A while the force (T*l*A)/(*l*A + *l*B), to the movable contact 38B. Let TR denote the force required for projecting the dome-shaped contacts 38A and 38B in the opposite (downward) direction so that they may be pressed against the stationary contacts 40A and 40B, respectively. Then the force TA required for projecting the dome-shaped contact 38A in the opposite direction and making it into contact with the stationary contact 40A is given by $$TR\ lA/(lA + lB).$$

In like manner, the force TB for the dome-shaped contact 38B is given by $$TR/B/(lA + lB).$$

since $lA < lB$, $$TA < TB.$$

Figure 14:
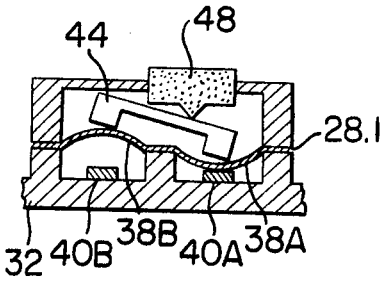
FIGS. 14 and 15 are views used for the explanation of the mode of operation of the key shown in FIG. 5.
Figure 15:
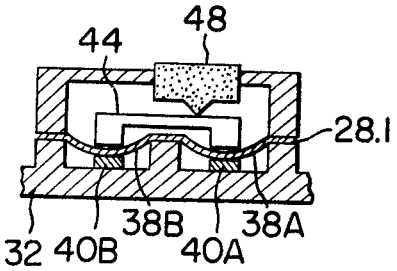

Therefore when the force T(TA < T < TB) is applied to the keytop 48, the dome-shaped contact 38A is forced into electrical contact with the stationary contact 40A as shown in FIG. 14 so that the first switching means 42A may be closed. When the force T is increased so that TA < TB < T, the dome-shaped contact 38B is also forced into the electrical contact with the stationary contact 40B so that the second switching means 42B is also closed as shown in FIG. 15. When one depresses the forward space key 22 with the force TA = TR *l*A/(*l*A + *l*B), the first switching means 42A is closed as shown in FIG. 14 so that the key switch K11 shown in FIG. 5 connects the output line D1 of the decoder 52 to the line L1. As long as the outputs from the flip-flops F3, F4 and F5, which make up the counter 50 which is driven in response to the clock pulses CP, remain "O"s, the output signal in the output line D1 of the decoder 52 remains at a high level. Therefore the high-level signal is applied through the key switch K11 to the NAND gate 54. The output So from the NOR gate 62, to which are applied the outputs from the flip-flops F1 and F2 of the counter 50, is also applied to the NAND gate 54. Therefore, when the output from the counter 50 is 00000 as shown in FIG. 7, the output signal on the output line D1 from the decoder 52 becomes the key signal, which is transmitted to the set terminals of the flip-flops 88–96 through the NAND gate 54 and NAND gates 84 and 86 in response to the signal SO. The outputs 0,0,0,0,0 from the flip-flops F1–F5 of the counter 50 are transferred into the flip-flops 88–96, respectively, of the input buffer IB.

Under the control of the clock pulses CP, the key signal is transferred through the NAND gate 54 into the circulating register comprising the shift registers 82 and 102. The key signal stored in the circulating register is applied to one input terminal of the NAND gate 86 for every 32 bits. The signal IH is applied to the NAND gate 86 so that the key signal to reset the flip-flops 88–96 may not be applied to them through the NAND gate 86 during a predetermined time after the signal KST is derived from the OR gate 98 which is provided in order to inform the control circuit CC that the key is depressed.

The encoded signal which represents one input entered by the space key 22 and is stored in the input buffer IB is transferred to the decoder 106 in the control circuit CC through the AND gate 104. The AND gate 104 is opened in response to the signal SET1 which is generated by counter means (not shown) after it has counted a predetermined number of clock pulses generated by clock pulse generator means (not shown) which starts generating the clock pulses a predetermined time after the signal KST is derived from the OR gate 98 shown in FIG. 5. The encoded signal from the input buffer IB is decoded by the decoder 106 so that the group of flip-flops for instance E1 is set to generate the control signal E1. The control signal is applied through an OR gate GM1 shown in FIG. 10 to means OS for generating the signal END after having counted a predetermined number of pulses TMD and to an AND gate GM2. In response to the control signal E1, the pulses TMD are applied through the AND gate GM2 and an OR gate GM3 to the AND gates 134–140, so that they are opened. Therefore, the outputs at the output terminals ML1–ML4, which in turn are derived from the outputs from the flip-flops 122 and 124 by the matrix circuit 132, are sequentially applied to the transistors 142–148 in the motor drive MD.

Next the mode of operation of the counter 126 comprising the flip-flops 122 and 124 and the drive signals applied to the AND gates 134—140 will be described in more detail hereinafter. The counter 126 is driven in response to the pulses TMD which has the same pulse duration with that of the signals GS1, GS2, GS3, GS4 and so on of the signal GSS derived from the ring counter 116 described hereinbefore with reference to FIG. 9. When both the outputs QA and QB from the flip-flops 122 and 124 are at the "0" level, they are applied directly and through the inverters 128 and 130 to the input terminals MD1–MD4 of the matrix circuit 132. The output from the flip-flop 124 which is applied to the matrix circuit 132 through the inverter 130 is encoded into the "1" level signal which in turn is applied to the AND gate 134. The outputs from the flip-flops 122 and 124 which are inverted by the inverters 128 and 130, respectively, pass through the AND and OR gates within the matrix circuit 132, appears at the output terminal ML1, and is applied to the AND gate 140. To the AND gate 136 is applied the "0" level signal from the flip-flop 124 while the "0" level signal from the flip-flop 122 and the "1" level signal from the inverter 130 connected to the flip-flop 124 are encoded by the matrix circuit 132 into the "0" level drive signal to be applied to the AND gate 138. Thus, when both the output signals from the flip-flops 122 and 124 are "0"s, the drive signals applied to the AND gates 134–140 are 1,0,0,1, respectively. The inverted "1" signal is applied to the input of the flip-flop 122 while to the input of the flip-flop 124 is applied the encoded signal derived from the matrix circuit 132 from the signal RS and the outputs from the flip-flops 122 and 124. The signal RS is applied in order to reverse the rotation of the step motor 150. That is, when the signal RS is "1", the step motor 150 is rotated in the direction for feeding the paper tape, and the "0" level signal is applied to the input terminal of the flip-flop 124. When the pulse TMD is applied to both flip-flops 122 and 124, the output from the flip-flop 122 changes to the "1" level signal while the "0" level output signal from the flip-flop 124 remains unchanged. Therefore, the outputs at the output terminals ML1–ML4 of the matrix circuit 132 are 0,1,0,1, respectively, which are applied simultaneously to the input terminals of the AND gates 140, 138, 136 and 134. In like manner, in response to the pulses TMD applied to the flip-flops 122 and 124, the inputs to the AND gates 134–140 change as shown in FIG. 10(a), so that the step motor 150 is intermittently driven. It will be easily understood by those skilled in the art that when the signal RS changes to "0", the sequence of the inputs applied to the AND gates 134–140 is reversed.

The step motor 150 is driven in the manner described above so that the recording paper tape 204 is transported by the rubber roller 194. However, when seven pulses TMD are applied to the flip-flops 122 and 124, the step motor 150 is stopped in response to the output from the means OS which counts the pulses TMD in response to the control signal E1 from the flip-flop 108 to be described in detail hereinafter. Thus the paper tape 204 is displaced by one space.

When the space key 22 is depressed further, the second switching means 42B is closed as shown in FIG. 15 so that the key switch K21 shown in FIG. 5 is closed. Therefore, in response to the output signal S2 transmitted from the decoder 52 and the output signal from NOR gate 62 transmitted through the NAND gates 54 and 84, the output 00100 from the counter 50 is transferred into the flip-flops 88–96 of the input buffer IB. In this case the key switch K11 is closed, and the signal consisting of the output signal S1 from the decoder 52 and the output from the NOR gate 62 is stored in the shift registers 82 and 102 of the circulating register. But when the signal is circulated from the NAND gate 84 to the flip-flop 102.1 of the shifter register 102, the NAND gates 100.1 and 100.2 are controlled in response to the output G from the NAND gate 84 which is delayed by the delay means J and to the control signal E2 from the flip-flop 110 so that the output signal KST representative of the closed first switching means 42A is not derived. Therefore, only the signal generated when the second switching means 42B is closed is transmitted through the NAND gates 54, 84 and 86, and is applied to the set terminals of the flip-flops 88–96. Thus the code signal 00100 is transferred into the input buffer IB. In response to the signal SET 1 derived a predetermined time after the signal KST is decoded by the decoder 106 so that the flip-flop 110 generate the control signal E2. The control signal E2 is applied to the OR gate GM1 so that the pulses TMD are transmitted to the AND gates 134–140 in a manner substantially similar to that described elsewhere in conjunction with the control signal E1. Therefore, the step motor 150 is intermittently driven. In this case, the output signal KST; that is, the output from the NOR gate 98 is derived from the AND gate 100.2 to which is applied the control signal E2 and the signal S2 so that the content in the input buffer IB may be read out. Therefore, as long as the second switching means 42B remains closed, both the control signal E2 and the output signal KST may be repeatedly derived so that the paper tape may be continuously shifted without being printed. The control signal E2 is also applied to the means OS (See FIG. 10) so that when the second switching means 42B is opened the AND gate 100.2 is closed. As a result, no KST signal may be derived, and in response to the output from the means OS the repeat forward spacing is stopped.

As described above, according to the present invention, when one depresses the forward space key with a little pressure or holds down the space key in a short stroke, the first switching means 42A is closed so that the paper tape may be shifted by one space without being printed, and when one depresses the space key with a little extra pressure or holds it down further, the second switching means 42B is also closed so that the repeat forward spacing may be accomplished. As described elsewhere, the pressure TA required for closing the first switching means 42A and the pressure TB required for closing the second switching means 42B may be suitably selected by selecting the position of the projection 46 of the key top in contact with the interposer 44 bridging between the dome-shaped movable contacts 38A and 38B (See FIG. 4).

Figure 16:
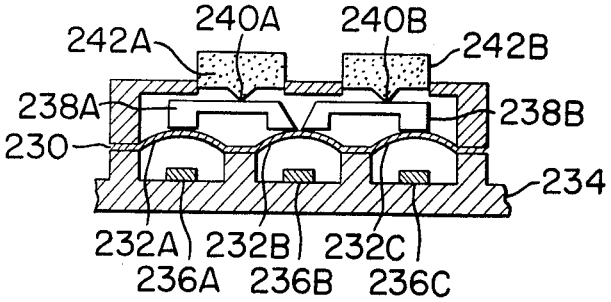
FIG. 16 is a sectional view of a key used in a second embodiment of the present invention.

Second Embodiment, FIG. 16

FIG. 16 shows the second embodiment of an input device in accordance with the present invention. The input device comprises two key tops 242A and 242B, three dome-shaped movable contacts 232A, 232B and 232C formed in an electrically conductive and elastic plate 230 in a manner substantially similar to that described with reference to FIGS. 3 and 4, three stationary contacts 236A, 236B and 236C placed upon an insulating base plate 234, and two interposers 238A and 238B, the former bridging between the dome-shaped contacts 232A and 232B while the latter, between the dome-shaped contacts 232B and 232C. The downwardly directed projections 240A and 240B of the key tops 242A and 242B which are in contact with the interposers 238A and 238B, respectively, are so positioned that the distances between the tops of the domeshaped contacts 232A and 232B and between the tops of the domeshaped contacts 232B and 232C may be divided in a suitable ratio as with the case of the first embodiment. The key top 242A may be used as the space key 22 while the key top 242B, as the back space key 24 shown in FIG. 1.

When the key top 242A is depressed with a predetermined stroke, the dome-shaped movable contact 232B is made to contact with the stationary contact 236B. When the key top 242A is depressed further, the dome-shaped movable contact 232A is also made to contact with the stationary contact 236A.

When the key top 242B which is used as the back space key 22, is depressed, the dome-shaped contact 232C is first made to contact with the stationary contact 236C so that one back spacing is made. More particularly, when the movable contact 232C is made to contact with the corresponding stationary contact 236C, the encoded signal is transferred into the input buffer 1B in a manner substantially similar to that described with reference to the first embodiment. After a predetermined time, the encoded signal is decoded so that the flip-flop 112 is set. Therefore, the inverted output E3 from the flip-flop 112 is applied as the signal RS (shown in FIG. 10) to the matrix circuit 132 so that the outputs from the matrix circuit 132 are applied to the AND gates 134–140 in the sequence opposite to that described in the first embodiment with reference to the forward space key. When the key top 242B is depressed further, the dome-shaped contact 232B is made to contact with the corresponding stationary contact 236B so that the control signal E1 for effecting one spacing of the paper tape may be generated. The AND gates 134-140 are opened so that the step motor 150 is rotated in the reverse direction, and the paper tape 204 is rewound by one space. Thus back spacing is accomplished.

In the second embodiment, the arrangement of the key tops 242A and 242B may be changed as needs demand. For instance, when the forward space key 22 and the back space key 24 are arranged in the character L configuration as shown in FIG. 1, the first, second and third switching means may be also arranged in the character L configuration.

Figure 17:
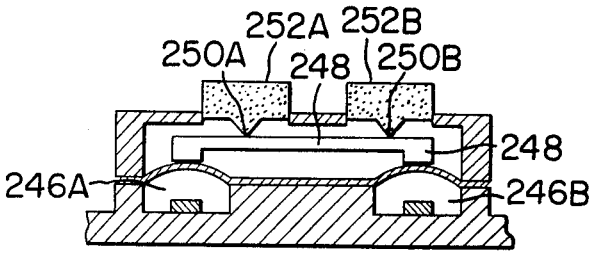
FIG. 17 is a sectional view of a key used in a third embodiment of the present invention.

Third Embodiment, FIG. 17

FIG. 17 is a sectional view of the third embodiment of an input device in accordance with the present invention. The third embodiment comprises two key tops 252A and 252B, two switching means 246A and 246B consisting of dome-shaped movable contacts, and stationary contacts and an interposer interposed between the dome-shaped movable contacts and the key tops 252A. The downwardly directed projections 250A and 250B of the key tops 252A and 252B are made to contact with the interposer 248 so that when the key top 252A is depressed the first switching means 246A is closed while when the key top 252B is depressed, the second switching means 246B is closed.

The combinations of the key tops 252A and 252B and the first and second switching means 246A and 246B may be used as the back space key 24 and the correction key 26 shown in FIG. 1. The back space key and the correction key are connected to suitable key switches $K_{11}$–$K_{14}$, . . . ., $K_{81}$–$K_{84}$ shown in FIG. 5. When the key is depressed, the coded signal is generated, and after a predetermined time the coded signal is decoded by the decoder 106 shown in FIG. 8 so that the flip-flop is set to generate the control signal in a manner substantially similar to that described in the first embodiment. Assume that one has printed "K" instead of "Y". Then the encoded signal representative of "K" is generated by the encoder ES shown in FIG. 5, and is decoded by the decoder 106 in response to the control signal SET1 generated a predetermined time after the encoded signal is generated. Therefore the flip-flop 114 is set to generate the control signal E4, in response to which the five-bit code signal stored in the input buffer IB is transferred into the register R and the drive signal for driving the motor drive MD is generated. In response to this drive signal, the clock pulses TMP are applied to the ring counter 116 shown in FIG. 9. Referring to FIG. 9, the outputs Q from all flip-flops RF0-RF12 are "1"s so that the outputs from the inverters I0–I12 are all "0"s. Therefore, the "0" output is applied to the input terminal D of the flip-flop RF0. When the clock pulse TMP is applied, the Q output from the flip-flop RF0 changes to "0". The "0" output is applied to the D input terminal of the flip-flop RF1 in the next stage and to the inverter Io. The output from the inverter I0 is therefore "1" which is the step control signal GS0 to be applied to the stepping motor. In response to the next clock pulse, the output from the flip-flop RF1 changes to "0". The "0" output is applied to the D input terminal of the flip-flop RF2 and to the inverter I1. The output from the inverter I1 is therefore "1", which is the printing control signal PS1. In like manner, the outputs from the flip-flops RF3–RF12 change to "0"s in synchronism with the clock pulses TMP. As a result, as shown in FIG. 9(a), the printing control signals PS1–PS5 and the step control signal GS0–GS5 for stepping the paper tape 204 are alternately derived. The printing control signal to be derived from the flip-flop RF 11 is inhibited and the step control signal S6 for stepping the paper tape 204 for spacing may be also derived. These printing control signals PS1–PS5 and the step control signals GS0–GS6 pass through OR gates so that the signals in the waveforms shown in FIG. 9(a) are derived at the terminals GPP and GSS.

Figure 18:
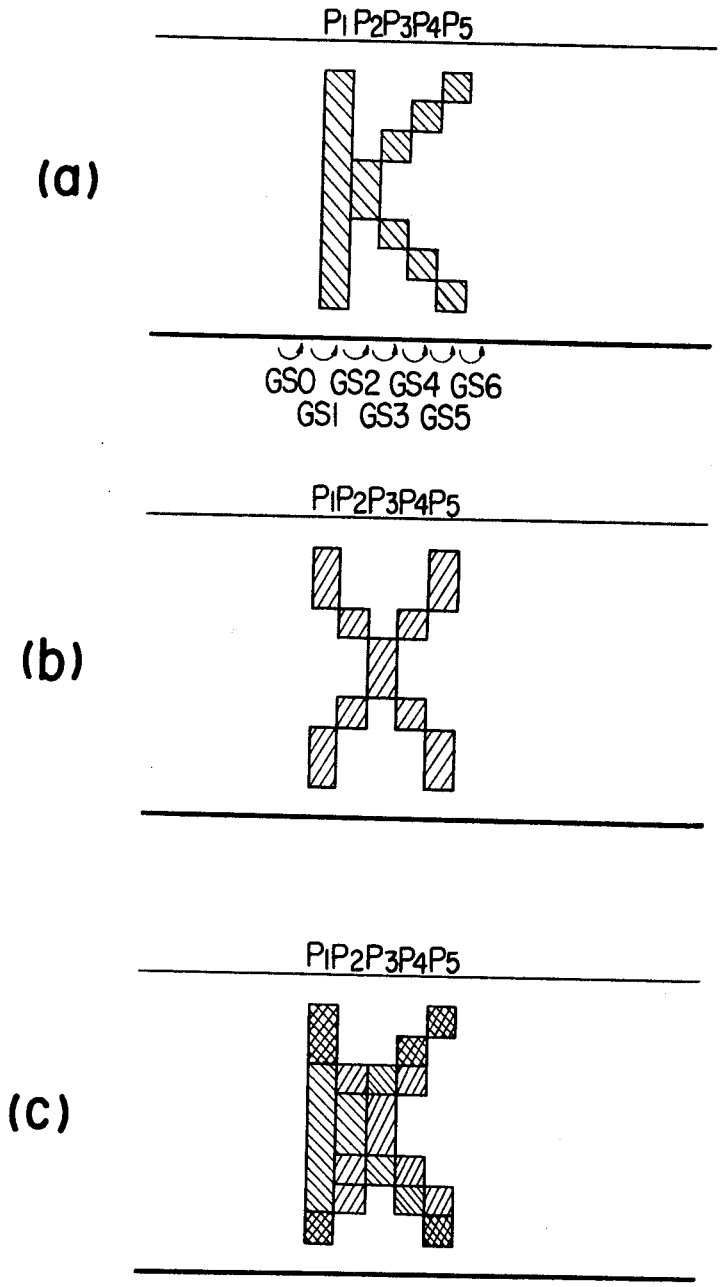
FIGS. 18(a)–(c) are views used for the explanation of the mode of operation of the third embodiment.

Referring back to FIG. 11, the encoded signal transferred into the register R is applied to the input terminals CD1–CD10 of the decoder 162 so that the "1" level output signals which represent the input signal are applied to the pattern matrix 164. The outputs from the matrix 164 are transmitted to the OR matrix 176 through the AND gates 166 and 168 which are controlled in response to the signals PS1–PS5 derived from the ring counter 116. The outputs from the OR matrix 176 are transmitted through the driving circuit 178 to the thermal head PH. The mode of operation will be described in more detail hereinafter. In the instant embodiment, a letter is represented by a (7 × 5) dot matrix consisting of 7 columns of dots and five rows of dots. Each letter to be printed is divided into five columns, and printing is made one column by one column. More particularly, after the thermal head PH with seven heating elements have printed one column, the paper tape is advanced by one step or column so that the next printing may be made. This will be described in more detail hereinafter. When the control signal E1 is derived from the flip-flop 114, the ring counter 116 is actuated in response to the clock pulses TMP so that the step control signal SO is transmitted from the output terminal GSS of the OR gate matrix 120 to the OR gate GM3. As a result, the tape is advanced one step without being printed. Thereafter, the pringing control signal PS1 is applied to the thermal head PH so that the first column is printed as shown in FIG. 18(a). Thereafter, the step control signal GS1 is applied to the step motor 150 so that the latter rotates through the gears 188 and 192 the rubber roller 194 in the direction indicated by the arrow *x*. Therefore the paper tape 204 is stepped by one column, and the printing control signal PS2 is applied to the thermal head PH so that printing of the second column P2 is made. In like manner, the third, fourth and fifth columns P3, P4 and P5 are printed so that the letter "K" is printed as shown in FIG. 18(a). In response to the step control signal GS5 which appears after the printing control signal for the fifth column P5, the step motor advances the paper tape by one column so that the thermal head PH is in opposed relation with the column next to the fifth column.

If the printing of the next letter is to be started from this position, there is no space between the adjacent printed letters so that it becomes difficult to read the printed information. To overcome this problem, according to the present invention, the step control signal GS6 is applied in succession of the step control signal GS5 so that the step motor 150 advances the paper tape by one more column. Therefore, the first column of the next letter to be printed may be spaced apart from the fifth column of the printed letter by one column. In response to the step control signal GS6, the printing of one letter is accomplished.

In order to correct the letter "K" printed in the manner described above, one depresses the back space key 24 so that the first switching means 246A is closed. The encoded signal and the signal KST are generated in the manner described above, and after a predetermined time the SET1 signal is applied to the AND gate 104 so that the coded signal representative of the back spacing is applied to the decoder 106. In response to the output from the decoder 106, the flip-flop 110 is set so that the signal E2 is derived. In the instant embodiment, the signal E2 represents the back spacing instruction. The "0" level RS signal which is derived by inverting the signal E2 is applied to the matrix circuit 132, whilst the signal E2 is applied to the means OS and to the AND GM2. Therefore the pulses TMD are applied to the AND gates 134–140, which are opened for a time determined by the means OS in response to the signal E2. As a result, the output signals from the matrix circuit 132 for reversing the step motor 150 are transmitted from its output terminals ML1–ML4 through the gates 134–140 to the step motion 150. The step motor 150 is rotated in the reverse direction so that the paper tape is rewound. When the paper tape is returned to the position where the printing of the letter "K" is started, the means OS generates the back spacing completion signal, in response to which the flip-flop 110 is reset. When the back space key 24 is further depressed, the second switching means 246B is closed, the coded signal representative of "X" is generated by the encoder ES and is transferred into the input buffer IB in a manner substantially similar to that described hereinbefore. In this case, the code signal representative of the back spacing is not transferred into the input buffer IB because of the reason described elsewhere. The encoded signal stored in the input buffer IB is decoded by the decoder 106 a predetermined time after the coded signal is transferred into the input buffer IB so that the flip-flop 114 is set, as with the case when the key "K" is depressed, generating the signal E4. In response to the signal E4, the coded signal representative of the correction information "X" is entered into the register R so that "X" shown in FIG. 18(b) is printed in the space where "K" was printed in a manner substantially similar to that described with reference to the printing of "K". Therefore, the misprinted "K" is erased as shown in FIG. 18(c).

The letter "X" may be also printed in the manner described above.

In the embodiments described hereinbefore, the pulses TMD for spacing have been described as being derived from the pulse generator, but it is to be understood that an arrangement may be made for deriving the pulses TMD from the ring counter. In the input device of the type described above for selectively entering two different instructions by one key, it is preferable for the error correcting operation of the keyboard for that a plurality of signals be generated by the switching means, or other suitable means, when one key top is depressed.

We claim:

1. In apparatus of the type wherein desired letters, symbols or the like may be printed in a given direction on a recording medium by a printing device, in response to the depression of corresponding keys on a keyboard, and having means for effecting relative displacement between said printing device and said recording medium wherein said printing device and said recording medium are relatively displaced in said given direction after the printing of each of said letters, symbols or the like, and means for printing a corrective character on said recording medium, an input device comprising:

(a) first switching means for generating a first instruction for effecting relative displacement between said printing device and said recording medium in the direction opposite to said given direction;

(b) second switching means for generating a second instruction for actuating said corrective character means;

(c) a first push button;

(d) a second push button;

(e) means responsive to the displacements of said first and second push buttons for discriminatively actuating said first and second switching means so that said first switching means and said second switching means are driven in the aforementioned order by the displacement of said first push button and that said second switching means and said first switching means are driven in the aforementioned order by the displacement of said second push button.

2. In apparatus of the type wherein desired letters, symbols or the like may be printed in a given direction on a recording medium by printing means, in response to the depression of corresponding keys on a keyboard, and having means for effecting relative displacement between said printing means and said recording medium wherein said printing means and said recording medium are relatively displaced in said given direction after the printing of each of said letters, symbols or the like, and means for printing a corrective character on said recording medium, an input device comprising:

(a) first switching means for generating a first instruction for effecting relative displacement between said printing means and said recording medium in the direction opposite to said given direction;

(b) second switching means for generating a second instruction for driving said corrective character means;

(c) transmission means bridged across said first and second switching means for discriminatively actuating said first and second switching means in response to the application of external force thereto;

(d) first means positioned at a first location displaced from the center of the distance between said first and second switching means for applying said external force to said transmission means so that said first switching means and said second switching means are discriminatively actuated in the aforementioned order;

(e) second means positioned at a second location displaced from the center of the distance between said first and second switching means for applying said external force to said transmission means so that said second switching means and said first switching means are discriminatively actuated in the aforementioned order.

3. An input device for electronic apparatus comprising:

(a) first switching means for generating a first instruction;

(b) second switching means for generating a second instruction;

(c) third switching means for generating a third instruction;

(e) first transmission means bridged across said first and second switching means for discriminatively actuating said first and second switching means in response to the application of external force thereto;

(e) second transmission means bridged across said second and third switching means for discriminatively actuating said second and third switching means in response to the application of external force thereto;

(f) first means positioned at a location displaced from the center of the distance between said first and second switching means for applying said external force to said first transmission means so that said second switching means and said first switching means are discriminatively actuated in a predetermined order;

(g) second means positioned at a location displaced from the center of the distance between said second and third switching means for applying said external force to said second transmission means so that said third switching means and said second switching means are discriminatively actuated in a predetermined order.

4. A device of the type wherein desired letters, symbols or the like are recorded on a recording medium by a recording device, in response to the depression of corresponding keys on a keyboard, and having means for effecting relative displacements between said recording device and said recording medium, which comprises:

(a) first switching means for generating a first instruction;

(b) second switching means for generating a second instruction;

(c) third switching means for generating a third instruction;

(d) first transmission means bridged across said first and second switching means for discriminatively actuating said first and second switching means in response to the application of external force thereto;

(e) second transmission means bridged across said third and first switching means for discriminatively actuating said third and first switching means in response to the application of external force thereto;

(f) first means positioned at a location displaced from the center of the distance between said first and second switching means for applying said external force to said first transmission means so that said first switching means and said second switching means are discriminatively actuated;

(g) second means positioned at a location displaced from the center of the distance between said third and said first switching means for applying said external force to said second transmission means so that said third switching means and said first switching means are discriminatively acutated;

(h) means responsive to said first instruction for effecting a first relative displacement between said recording device and said recording medium;

(i) means responsive to said second instruction for effecting a second relative displacement between said recording device and said recording medium; and (j) means responsive to said third instruction for effecting a third relative displacement between said recording device and said recording medium in a direction opposite to said first and second displacements.

5. A device as defined in claim 4, further comprising means for applying periodic pulse signals to said first and second switching means, respectively, and for deriving coded signals from said pulse signals in response to actuation of either one of said first and second switching means, said coded signals representing corresponding instructions.

6. A device as defined in claim 3, further comprising means for generating a timing signal, and means coupled to said first and second switching means for generating periodic signals in response to actuation of either one of said first and second switching means and for deriving coded signals from said periodic and said timing signals, the coded signals representing corresponding instructions.

7. An input device for electronic apparatus comprising:

(a) first switching means for generating a first instruction;

(b) second switching means for generating a second instruction;

(c) transmission means bridged across said first and second switching means for discriminatively actuating said first and second switching means in response to the application of external force thereto;

(d) first means positioned at a first location displaced from the center of the distance between said first first and second switching means for applying said external force to said transmission means so that said first switching means and said second switching means are discriminatively actuated in the aforementioned order;

(e) second means positioned at a second location displaced from the center of the distance between said first and second switching means for applying said external force to said transmission means so that said second switching means and said first switching means are discriminatively actuated in the aforementioned order;

(f) pulse signal generating means for generating and applying signals to said first and second switching means; and (g) a discriminating circuit responsive to said pulse signals for providing an output in response to actuation of said second switching means, while continuous actuation of said first switching means is maintained.

8. A device as defined in claim 2, wherein said corrective character means comprises means coupled to said second switching means for generating a code signal corresponding to the character X of an alphabet.

9. In apparatus of the type wherein desired letters, symbols or the like may be recorded on a recording medium by a recording device, in response to the depression of corresponding keys on a keyboard, and having means for effecting relative displacements between said recording medium and said recording device, an input device comprising:

(a) first switching means for generating an instruction of a first displacement between said recording device and said recording medium;

(b) second switching means for generating an instruction of a second displacement between said recording device and said recording medium;

(c) transmission means bridged across said first and second switching means for discriminatively actuating said first and second switching means in response to the application of external force thereto;

(d) means positioned at a location displaced from the center of the distance between said first and second switching means for applying said external force to said transmission means so that said first switching means and said second switching means are discriminatively actuated in the aforementioned order;

(e) pulse signal generating means for generating and applying signals to said first and second switching means;

(f) a discriminating circuit responsive to said pulse signals for providing an output in response to actuation of said second switching means, while continuous actuation of said first switching means is maintained; and, (g) code signal generating means coupled to said discriminating circuit for generating code signals, corresponding to operation of said second switching means, when said discriminating circuit output is provided.

10. Apparatus of the type wherein desired letters, symbols or the like may be printed in a given direction on a recording medium by printing means, in response to the depression of corresponding keys on a keyboard, and having means for effecting relative displacement between said printing means and said recording medium wherein said printing means and said recording medium are relatively displaced in said given direction after the printing of each of said letters, symbols or the like, and means for printing a corrective character on said recording medium, said apparatus comprising:

(a) first switching means for generating a first instruction for effecting relative displacement between said printing means and said recording medium in the direction opposite to said given direction;

(b) second switching means for generating a second instruction for driving said corrective character means;

(c) a first push button;

(d) a second push button; and (e) means responsive to the displacements of said first and second push buttons for discriminatively actuating said first and second switching means so that said first switching means and said second switching means are driven in the aforementioned order by the displacement of said first push button and that said second switching means is driven by the displacement of said second push button said corrective character means being operative to print an alphabetical character symbol on said recording medium, in response to said second instruction generated in said second switching means upon actuation of said second push button.

11. Apparatus as defined in claim 3, wherein said corrective character means comprises means for generating a signal corresponding to the character X of an alphabet and for printing the character X on the recording medium in response to said signal.

* * * * *

UNITED STATES PATENT OFFICE

CERTIFICATE OF CORRECTION

Patent No. 4,096,935 Dated June 27, 1978

Inventor(s) TAKAYOSHI HANAKATA,et al.

It is certified that error appears in the above-identified patent and that said Letters Patent are hereby corrected as shown below:

| | | |
|---|---|---|
| Column 2, | line 16 | Change "Fig. 3" to --Fig. 5--; |
| | line 64 | Change "corresponing" to --corresponding-- |
| Column 4, | line 15 | Change "line Ll-L4" to --lines Ll-L4--; |
| | line 40 | Change "latters" to --latter--; |
| | line 54 | Change "switchs" to --switches--. |

Signed and Sealed this

Sixth Day of March 1979

[SEAL]

*Attest:*

RUTH C. MASON
*Attesting Officer*

DONALD W. BANNER
*Commissioner of Patents and Trademarks*